United States Patent [19]

Hirosawa

[11] 4,341,723

[45] Jul. 27, 1982

[54] VARIABLE VENTURI CARBURETOR

[76] Inventor: Hidenori Hirosawa, 6-2, Nishihata, Kyowa-cho, Obu-shi, Aichi-ken, Japan

[21] Appl. No.: 219,524

[22] Filed: Dec. 23, 1980

[30] Foreign Application Priority Data

Aug. 26, 1980 [JP] Japan ..... 55-121546[U]

[51] Int. Cl.[3] ..... F02M 9/06

[52] U.S. Cl. ..... 261/44 C; 123/DIG. 11; 261/121 B; 261/DIG. 74

[58] Field of Search ..... 261/44 C, 44 B, 44 F, 261/DIG. 74, 121 B; 123/DIG. 11

[56] References Cited

U.S. PATENT DOCUMENTS

| | | | |
|---|---|---|---|
| 1,444,222 | 2/1923 | Trego | 261/44 B |
| 3,455,260 | 7/1969 | Mennesson | 261/44 C |
| 3,618,581 | 11/1971 | Simonet | 261/DIG. 74 |
| 3,764,120 | 10/1973 | Imai | 261/44 C |
| 3,765,658 | 10/1973 | Hartel et al. | 261/44 C |
| 3,855,974 | 12/1974 | Mayer | 261/44 C |
| 4,050,436 | 9/1977 | Crabtree | 123/DIG. 11 |
| 4,084,562 | 4/1978 | Eckert | 261/44 C |
| 4,251,472 | 2/1981 | Dammann | 261/44 C |
| 4,276,238 | 6/1981 | Yoshikawa et al. | 261/44 C |

FOREIGN PATENT DOCUMENTS

| | | | |
|---|---|---|---|
| 1290014 | 2/1962 | France | 261/44 B |
| 52-15932 | 5/1977 | Japan | 261/44 B |

*Primary Examiner*—Tim R. Miles

*Attorney, Agent, or Firm*—Blair, Brown & Kreten

[57] ABSTRACT

Disclosed herein is an improvement in a variable venturi carburetor for an internal combustion engine which comprises a venturi portion, a float chamber, a main fuel passage communicating with the venturi portion and with the float chamber, a main jet provided in the main fuel passage and a movable metering needle of which free end is adapted to control the size of the main jet and the base portion thereof is mounted to a suction piston adapted to transversely move with respect to the venturi portion in response to the condition of load on the internal combustion engine. The improvement includes provision of a fuel bypass which detours the main jet for supplying part of fuel to the venturi portion. The fuel bypass communicates with the atmosphere through one or more throttles.

4 Claims, 3 Drawing Figures

VARIABLE VENTURI CARBURETOR

BACKGROUND OF THE INVENTION

1. Field of the Invention

The present invention relates to a variable venturi carburetor for an internal combustion engine (hereinafter referred to as "engine") in which constant negative pressure in a venturi portion is utilized for controlling its air-fuel ratio.

2. Description of the Prior Art

In a conventional variable venturi carburetor, a fuel bypass provided in a float chamber detours a main fuel metering portion to communicate with a downstream portion of a throttle valve. Therefore, the flow of fuel flowing in the fuel bypass is widely changed in proportion to change in engine load such that the air-fuel ratio cannot be maintained constant with respect to the change in engine load.

SUMMARY OF THE INVENTION

It is an object of the present invention to provide a variable venturi carburetor which can maintain its air-fuel ratio of an engine substantially constant regardless of change in engine load.

It is another object of the present invention to provide a variable venturi carburetor which can control its air-fuel ratio as desire in case the engine is idly driven.

It is still another object of the present invention to provide a variable venturi carburetor which can prevent the engine from dieseling that might be caused by stoppage of the engine.

In a variable venturi carburetor according to the present invention, there is provided a fuel bypass detouring a main fuel metering portion for supplying part of the fuel to a venturi portion. Since the flow of the fuel supplied to the venturi portion through the fuel bypass is small in comparison with that of the main fuel when the engine is driven under load, the air-fuel ratio can be maintained constant regardless of change in engine load. When the engine is idly driven the air-fuel ratio can be also maintained constant, because the pressure of the venturi portion and the area of the bypass are constant respectively. In addition, the ratio of the flow of the bypass fuel and that of the main fuel becomes large so that the air-fuel ratio can be controlled by changing the flow of the bypass fuel. Further, the fuel bypass is provided with an electromagnetic valve for intercepting an outlet communicating with the venturi portion to effectively prevent the engine from dieseling that might be caused by stoppage of the engine.

DESCRIPTION OF THE PREFERRED EMBODIMENTS

Figure 1:
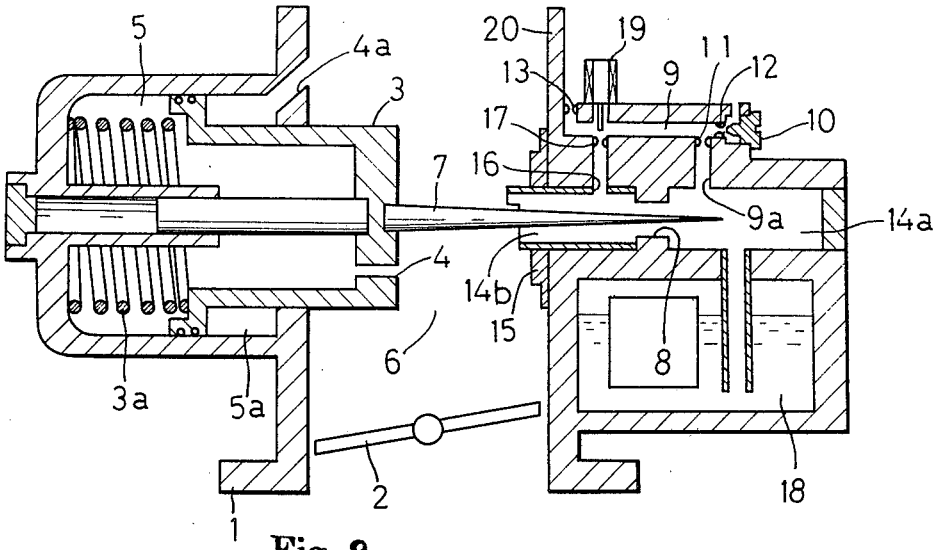
FIG. 1 is a longitudinal cross sectional view of a first embodiment of the present invention.

Referring now to FIG. 1 of the drawings, a variable venturi carburetor 1 has a venturi portion 6 which comprises a throttle valve 2, a suction piston 3 and a plate 15. A suction chamber 5 comprises a cylinder provided in the carburetor 1 and the suction piston 3 which is slidable in contact with the inner wall surface of the cylinder. The suction chamber 5 contains therewithin a coiled spring 3*a* which presses the suction piston 3 against the plate 15. In the bottom of the suction piston 3, there is provided a negative pressure passage 4 which makes the suction chamber 5 communicate with the venturi portion 6. A chamber 5*a* for intake air is defined between the rear surface of the slidable flange of the suction piston 3 and the body of the carburetor 1, into which air is introduced through an air passage 4*a* formed in the vicinity of the inlet of an air horn 20. A metering needle 7 is mounted to the central portion of the bottom of the suction piston 3 facing the venturi portion 6, and the free end thereof is inserted into the interior of a main jet 8 which is provided in the middle portion of a main fuel passage 14 formed in the upper portion of a float chamber 18. A portion 14*a* of the main fuel passage 14 upstream of the main jet 8 communicates with an inlet 9*a* of a fuel bypass 9, which detours the main jet 8 and has an outlet 16 communicating with another portion 14*b* of the main fuel passage 14 downstream of the main jet 8. Within the inlet 9*a* of the fuel bypass 9, there is provided a bypass jet 11, and a throttle 17 is provided within the outlet 16. The outlet 16 is further provided with an electromagnetic valve 19 for closing the throttle 17. In the vicinity of both ends of the fuel bypass 9, there are provided a pair of air passages which are provided in the inlets thereof with air throttles 12 and 13 respectively. An adjust screw 10 is provided for controlling the amount of throttling of the air throttle 12.

Figure 2:
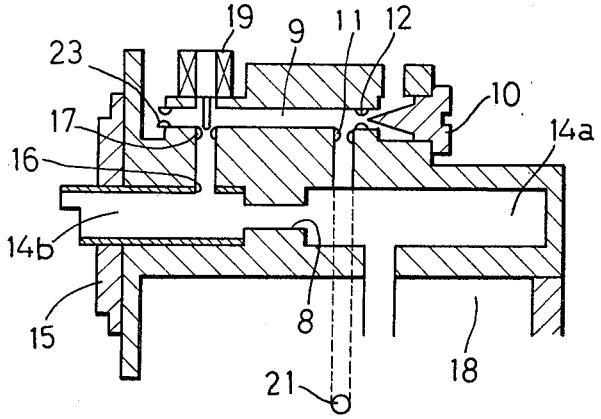
FIG. 2 is a longitudinal cross sectional view of a principal part of a second embodiment of the present invention.

FIG. 2 shows a second embodiment of the present invention in which the float chamber 18 has in its lower portion an inlet 21 of the fuel bypass.

Figure 3:
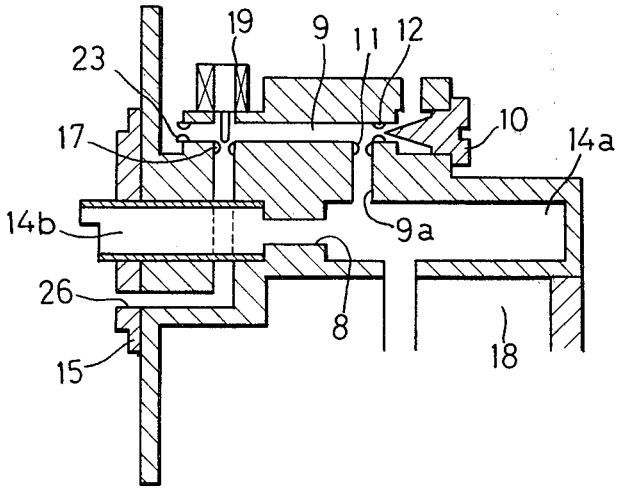
FIG. 3 is a longitudinal cross sectional view of a principal part of a third embodiment of the present invention.

FIG. 3 shows a third embodiment of the present invention in which an outlet 26 of the fuel bypass is directly formed in the side surface of the venturi portion.

In the variable venturi carburetor of the above construction, the venturi portion 6 is maintained at under constant negative pressure while the engine is driven. The main fuel is metered by the metering needle 7 and the main jet 8 so as to keep constant air-fuel ratio with respect to the flow of air sucked in accordance with opening of the throttle valve 2 which corresponds to the engine load and is injected into the venturi portion.

Since the fuel bypass 9 is also maintained at under constant negative pressure and the bypass jet 11 is certainly controlled, a constant flow of fuel is always sucked in the inlet 9*a* to be mixed with constant volume of air sucked from the air passages through the air throttles 12 and 13 in the fuel bypass 9 and injected into the downstream portion 14*b* of the main fuel passage 14 from the outlet 16 through the throttle 17.

In the second embodiment as shown in FIG. 2, the fuel to be injected into the fuel bypass 9 is directly sucked in the inlet 21 formed in the float chamber 18.

In the third embodiment as shown in FIG. 3, the air-fuel mixture in the fuel bypass 9 is directly injected from the outlet 26 of the fuel bypass formed in the venturi portion.

The fuel thus injected from the fuel bypass 9 into the venturi portion 6 is supplied in a constant flow regardless of the engine load. However, the flow of the bypass fuel f is considerably smaller than the flow of the main fuel F flowing through the main jet 8 while the engine is driven under load.

Therefore, the entire air-fuel ratio is substantially determined by the flow of the main fuel F and is almost constant while the engine is driven under load.

On the other hand, when the engine is idly driven, the ratio f/F of the flow of the bypass fuel f and the flow of the main fuel F becomes remarkably large in comparison with that in the case the engine is driven under load, and therefore the entire air-fuel ratio can be controlled by changing the flow of the fuel flowing through the fuel bypass 9. The flow of the fuel flowing through the fuel bypass 9 can be easily controlled by regulating the adjust screw 10 and the variable air throttle 12.

Further, when the engine is stopped, the electromagnetic valve 19 is driven to substantially close the throttle 17 and decrease the flow of the fuel flowing through the outlet 16 and thereby the air flowing through the air throttles 12 and 13 is introduced into the upstream portion 14*a* of the main fuel passage 14 to quickly reduce the flow of the main fuel. By virtue of this, the engine is prevented from dieseling that might be caused by stoppage of the engine.

While the invention has been described with reference to a few preferred embodiments thereof, it is to be understood that modifications or variations may be easily made without departing from the scope of this invention which is defined by the appended claims.

What is claimed is:

1. In combination with a variable venturi carburetor for an internal combustion engine comprising a venturi portion, a float chamber, a main fuel passage communicating with said venturi portion and with said float chamber, a main jet provided in said main fuel passage and a movable metering needle, a free end of said metering needle being adapted to control the size of said main jet and the base portion of said metering needle being mounted to a suction piston adapted to transversely move with respect to said venturi portion in response to the condition of load on said internal combustion engine, the improvement comprising a fuel bypass detouring said main jet for supplying part of the fuel in said main fuel passage to said venturi portion, a valve provided at the downstream portion of said fuel bypass for effectively closing said fuel bypass at stoppage of the engine, an air passage provided upstream of said valve and in said fuel bypass for communicating with atmospheric air and at least one air throttle including a variable throttle provided in said air passage.

2. The invention as defined in claim 1 wherein said fuel bypass makes a portion of said main fuel passage upstream of said main jet communicate with another portion of said main fuel passage downstream of said main jet.

3. The invention as defined in claim 1 wherein said fuel bypass makes said float chamber communicate with a portion of said main fuel passage downstream of said main jet.

4. The invention as defined in claim 1 wherein said fuel bypass makes a portion of said main fuel passage upstream of said main jet communicate with said venturi portion.

* * * * *

UNITED STATES PATENT AND TRADEMARK OFFICE

CERTIFICATE OF CORRECTION

PATENT NO. : 4,341,723

DATED : July 27,1982

INVENTOR(S) : Hidenori Hirosawa

It is certified that error appears in the above-identified patent and that said Letters Patent are hereby corrected as shown below:

On the title page add: -- /73/ Assignee: Aisan Kogyo Kabushiki Kaisha, Aichi-ken, Japan --.

Signed and Sealed this

Fourteenth Day of December 1982

[SEAL]

*Attest:*

GERALD J. MOSSINGHOFF

*Attesting Officer*

*Commissioner of Patents and Trademarks*